United States Patent [19]

Tanaka et al.

[11] 4,125,102

[45] Nov. 14, 1978

[54] FUEL CONTROL SYSTEM FOR INTERNAL COMBUSTION ENGINE

[75] Inventors: Eizi Tanaka, Anjo; Michihiro Ohashi, Handa; Hiroshi Mochizuki; Akira Nishimatsu, both of Okazaki, all of Japan

[73] Assignee: Nippon Soken, Inc., Nishio, Japan

[21] Appl. No.: 776,294

[22] Filed: Mar. 10, 1977

[30] Foreign Application Priority Data

Mar. 30, 1976 [JP] Japan ..... 51-34715

[51] Int. Cl.[2] ..... F02M 39/00

[52] U.S. Cl. ..... 123/139 AW; 123/139 BG; 261/50 A

[58] Field of Search ..... 123/139 AW, 139 BG, 123/139 BC; 261/50 A

[56] References Cited

U.S. PATENT DOCUMENTS

| | | | |
|---|---|---|---|
| 3,739,762 | 6/1973 | Jackson | 123/139 AW |
| 3,983,849 | 10/1976 | Stumpp | 123/139 AW |
| 4,036,194 | 7/1977 | Kobayashi | 123/139 AW |
| 4,040,405 | 8/1977 | Tanaka et al. | 123/139 AW |

FOREIGN PATENT DOCUMENTS

| | | | |
|---|---|---|---|
| 987,189 | 4/1976 | Canada | 261/50 A |
| 2,307,136 | 5/1976 | Fed. Rep. of Germany | 123/139 AW |

*Primary Examiner*—Charles J. Myhre
*Assistant Examiner*—P. S. Lall
*Attorney, Agent, or Firm*—Cushman, Darby & Cushman

[57] ABSTRACT

A fuel control system for a multicylinder internal combustion engine, wherein the fuel is metered by a fuel metering device having one fuel metering orifice whose degree of opening is variable depending upon the quantity of intake air and a differential pressure regulating valve for maintaining the differential pressure across the fuel metering orifice at a predetermined magnitude, and a distributor has a plurality of distribution valves equal in number to the cylinders of the engine, each distribution valve being hydraulically communicated with the fuel metering device, and a plurality of pressure equalizing valves also equal in number to the cylinders, each pressure equalizing valve being communicated with each distribution valve. The whole quantity of fuel to be supplied to the respective cylinders is precisely metered by the fuel metering device in proportion to the quantity of intake air, and the metered fuel is uniformly distributed among the fuel injection nozzles by the distributor.

3 Claims, 4 Drawing Figures

FUEL CONTROL SYSTEM FOR INTERNAL COMBUSTION ENGINE

CROSS-REFERENCE TO RELATED APPLICATION

The invention of this application has cross connection to the subject matter of the invention disclosed in copending application Ser. No. 665,443, filed on Mar. 9, 1976, now U.S. Pat. No. 4,058,100.

BACKGROUND OF THE INVENTION

The present invention relates to a fuel control system for an internal combustion engine for supplying continuously the fuel, which is metered in proportion to the quantity of intake air, to a plurality of fuel injection nozzles under a relatively low pressure.

In order to ensure the optimum engine operation, to minimize the emission of toxic pollutants and to attain fuel economy, the fuel control systems must be such that the fuel may be metered with a higher degree of accuracy depending upon the quantity of intake air and the metered fuel must be distributed among cylinders as uniformly as possible. To these ends, various systems have been devised and demonstrated. For instance, employed in one system are fuel injection nozzles which are fabricated with an extremely higher degree of dimensional accuracy so that their fuel injection characteristics may be as uniform as possible. In another system, fuel metering devices are provided for respective cylinders for individually metering the fuel to be charged into respective cylinders.

The former system has a problem that with the present level of fuel injection nozzle manufacturing techniques it is extremely difficult to fabricate the fuel injection nozzles with uniform fuel injection characteristics. Therefore, of an extremely large number of fuel injection nozzles, those having the similar characteristics must be selected. This is very tedious. In the latter system, the fuel metering devices must be also fabricated so as to have the same characteristics. In addition, the fuel metered by these devices is very small in quantity so that they must be also fabricated with an extremely higher degree of dimmensional accuracy with the inevitable increase in cost.

SUMMARY OF THE INVENTION

The present invention was made to solve the above and other problems encountered in the prior art fuel control systems for internal combustion engines.

One of the objects of the present invention is therefore to provide a fuel control system for an internal combustion engine wherein the whole fuel to be charged into respective cylinders is metered only through one fuel metering orifice in proportion to the quantity of intake air and the metered fuel is uniformly distributed among fuel injection nozzles by a fuel distributor whose operation is not adversely affected by the variation in fuel injection characteristics of the nozzles, whereby the fuel may be charged into the cylinders with a higher degree of accuracy and the fuel control system may be fabricated at less cost.

The above and other objects, features and advantages of the present invention will become more apparent from the following description of one preferred embodiment thereof taken in conjunction with the accompanying drawings.

DESCRIPTION OF THE PREFERRED EMBODIMENT

Figure 1:
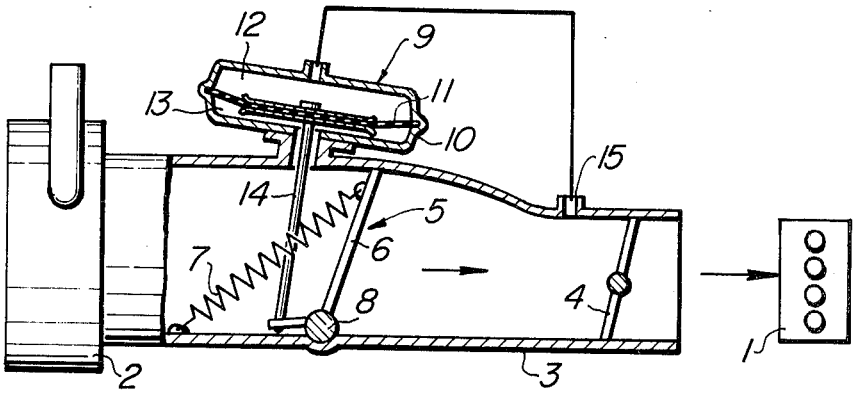
FIG. 1 is a schematic cross sectional view of an intake air metering device used in the present invention.

Referring first to FIG. 1, the air is charged from an air filter 2 through an intake tube 3 to a conventional spark ignition internal combustion engine 1. Disposed within the intake tube 3 is a throttle valve 4 which in turn is operatively coupled to an accelerator pedal (not shown), and disposed upstream of the throttle valve 4 is an air metering device 5 for metering the quantity of air to be sucked into the engine 1.

The air metering device 5 includes a sensing valve 6 swingably disposed within the intake tube 3 with a fuel metering shaft 8 for rotation in unison therewith and a return spring 7 loaded as resisting the rotation of the sensing valve 6 according to the flow of intake air.

A pressure responsive actuator generally indicated by the reference numeral 9 serves to maintain the pressure difference across the sensing valve 6 at a predetermined magnitude, and has a casing 10 which is divided by a diaphragm 11 into an upper pressure chamber 12 and a lower pressure chamber 13. The diaphragm 11 is operatively coupled with a connecting rod 14 to the sensing valve 6. The upper pressure chamber 12 is communicated with a pressure tapping port 15 downstream of the sensing valve 6 whereas the lower pressure chamber 13, with the intake tube 3 upstream of the sensing valve 6.

Figure 2:
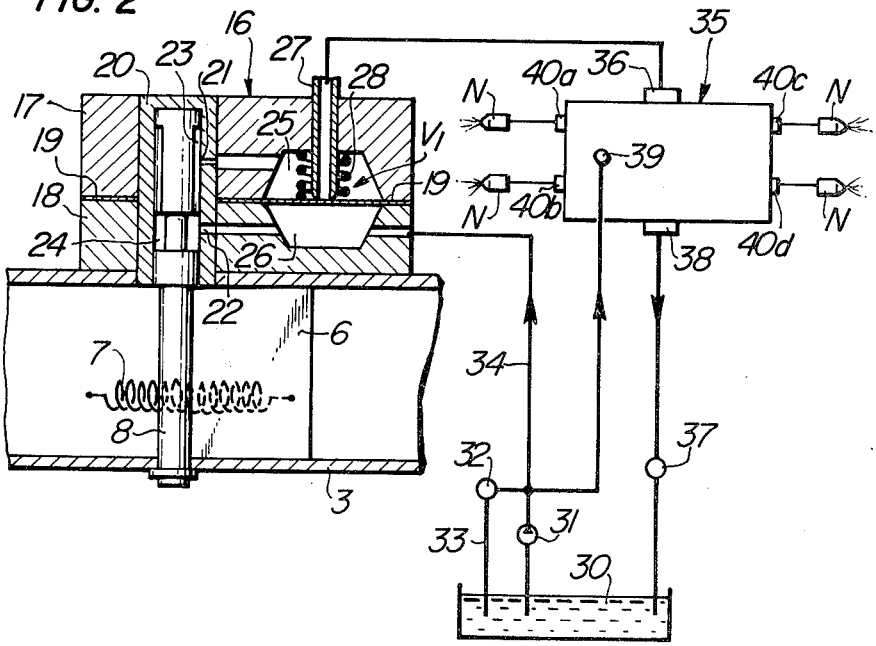
FIG. 2 is a schematic sectional view of a fuel metering device of the present invention with a fuel control system being diagrammatically shown.

Next referring to FIG. 2, a fuel supply system will be described. It includes a fuel metering device generally indicated by the reference numeral 16 and comprising upper and lower housing sections 17 and 18 with a metallic diaphragm 19 interposed therebetween. A bearing or cylinder member 20 securely fitted into the housing sections 17 and 18 has a cylindrical bore communicated with a fuel metering orifice 21 and a fuel inlet 22, the area of opening of the fuel metering orifice 21 being controlled depending upon the quantity of intake air as will be described in detail below. The fuel metering shaft 8 which is rotatable in unison with the sensing valve 6 is rotatably fitted into the cylinder bore of the member 20 and has a fuel metering surface 23 in opposed relation with the fuel metering orifice 21 and an annular groove 24 in communication with the fuel inlet port 22.

The upper and lower housing sections 17 and 18 and the metallic diaphragm 19 define an upper chamber 25 and a lower chamber 26 which are communicated with the fuel metering orifice 21 and the fuel intake port 22, respectively. A fuel pipe 27 extends into the upper chamber 25 and has its lower end terminated into a valve seat, and a coiled spring 28 is loaded in the upper chamber 25 for biasing the metallic diaphragm 19 downwardly which serves as a valve element. Thus, the diaphragm 19 and the fuel pipe 27 constitute a differential pressure regulating valve $V_1$ for maintaining the pressure difference of fuel across the orifice at a predetermined magnitude.

A fuel supply source consists of a fuel tank 30, a fuel pump 31 for pressurizing the fuel, a pressure regulator 32 and a return pipe 33 so that the fuel at a predetermined pressure may be supplied to the fuel metering device 16 through a fuel supply pipe 34 in communication with the lower chamber 26 in the fuel metering device.

The distributor 35 has a fuel inlet 36 in communication with the fuel pipe 27 of the fuel metering device 16, a fuel return port 38 communicated through a pressure regulator 37 with the fuel tank 30 for returning excess fuel, a second fuel inlet 39 in communication with the fuel supply source and fuel outlets 40*a*–40*d* in communication with fuel injection nozzles N which open into branched intake tubes for respective cylinders of the engine 1.

Figure 3:
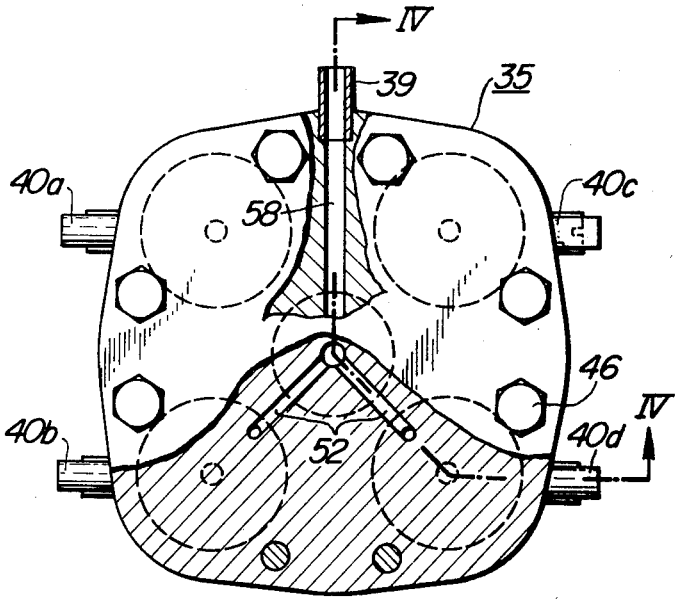
FIG. 3 is a top view, partly in section, of a distributor.
Figure 4:
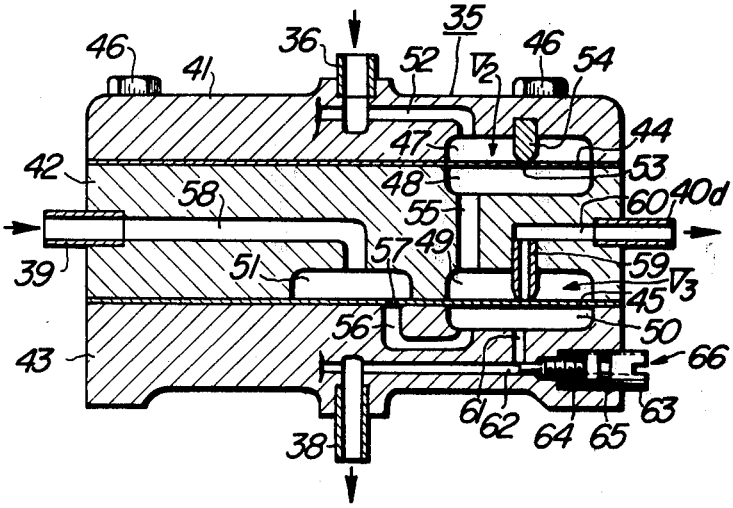
FIG. 4 is a sectional view taken along the line IV — IV of FIG. 3.

Next referring to FIGS. 3 and 4, the distributor 35 will be described in detail. It consists of three-split housing sections 41, 42 and 43 with a first metallic diaphragm 44 interposed between the first and second housing sections 41 and 42 and a second metallic diaphragm 45 interposed between the second and third housing sections 42 and 43. These housing sections 41, 42 and 43 and metallic diaphragms 44 and 45 are securely joined together with eight bolts 46. The distributor 35 which is for a four-cylinder engine has four pairs of upper and lower chambers 47 and 48 which are defined by the first and second housing sections 41 and 42 and the first metallic diaphragm 44 and four pairs of upper and lower chambers 49 and 50 which are defined by the second and third housing sections 42 and 43 and the second metallic diaphragm 45 and a center chamber 51 defined by the second housing section 42 and the second metallic diaphragm 45.

Each upper chamber 47 is communicated through a fuel passage 52 with the fuel inlet 36 and with the lower chamber 48 through a fixed orifice 53 formed through the first metallic diaphragm 44. A valve seat 54 is disposed within the upper chamber 47 in opposed relation with the orifice 53. Thus the valve seat 54 and the orifice 53 constitute a distribution valve $V_2$.

The upper chamber 49 is communicated through a fuel passage 55 with the lower chamber 48 of the distribution valve $V_2$, whereas the lower chamber 50 is communicated through a fuel passage 56, an orifice 57 having a fixed opening, the center chamber 51, and a fuel passage 58 with the second fuel inlet 39. A fuel pipe 59 which is communicated with the fuel outlet 40*a*, 40*b*, 40*c* or 40*d* through a fuel passage 60 extends downwardly into the upper chamber 49 and has its free end terminated into a valve seat which cooperates with the second metallic diaphragm 45 which serves as a valve element. The lower chamber 50 is also communicated through a control port 61 and a fuel passage 62 with the fuel return port 38. The degree or area of opening of the control port 61 in communication with the fuel passage 62 is adjusted by a fine pressure adjusting device generally indicated by the reference numeral 66 and consisting of an adjusting rod 63 screwed into the third housing section 43 and formed integral with a reduced-diameter stem which controls the degree of opening of the control port 61 to the fuel passage 62, a return spring 64 and an O-ring 65 for sealing purpose. Thus the upper and lower chambers 49 and 50, the second metallic diaphragm 45 and the fuel pipe 59 constitute a pressure equalizing valve $V_3$, whereas the fine pressure adjusting device 66 functions as a variable orifice for permitting the fine adjustment of the fuel pressure to be exerted to the pressure equalizing valve $V_3$.

Next the mode of operation of the fuel control system with the above construction will be described. Referring back to FIG. 1, the quantity of air to be charged into the engine 1 is controlled by the throttle valve 4 and flows from the air filter 2 through the intake tube 3 in the direction indicated by the arrow, opening the sensing valve 6. The sensing valve 6 is swung and held in an equilibrium position which is dependent upon the force of the air exerting on the sensing valve 6, the force transmitted from the pneumatic actuator 9 and the force of the return spring 7. Since the sensing valve 6 swings in unison with the fuel metering shaft 8, its fuel metering surface 23 determines the degree of opening of the fuel metering orifice 21 depending upon the quantity of intake air.

Meanwhile the fuel from the fuel tank 30 is pressurized by the fuel pump 31 and maintained at a predetermined pressure by the pressure regulator 32 so that the fuel under the predetermined pressure flows through the fuel pipe 34 into the lower chamber 26 in the fuel metering device 16, exerting the pressure on the metallic diaphragm 19. From the lower chamber 26 the fuel flows through the fuel inlet port 22 into the annular groove 24 and through a space between the cylinder bore and the fuel metering surface 23 of the shaft 8 and the fuel metering orifice 21 into the upper chamber 25. From the upper chamber 25 the fuel flows through the fuel pipe 27 to the fuel inlet 36 of the distributor 35 at a flow rate to be described below. The degree of opening of the differential pressure regulating valve $V_1$ defined by the lower end of the fuel pipe 27 and the metallic diaphragm 19 is so adjusted that the pressure across the metallic diaphragm 19 and hence across the fuel metering orifice 21 may be maintained at a predetermined differential pressure which is depending upon the rigidity of the metallic diaphragm 19 and the force of the coiled spring 28. Therefore the quantity of the fuel to be charged into all cylinders is controlled in response to the degree of opening of the fuel metering orifice 21; that is, in response to the quantity of intake air.

Referring back to FIGS. 3 and 4, the fuel flows from the inlet 36 through the fuel passage 52 into each upper chamber 47 of the distributor 35, from which the fuel flows further through the orifice 53 formed through the first metallic diaphragm 44 into the lower chamber 48. From the lower chamber 48, the fuel flows through the passage 55 into the upper chamber 49 of the pressure equalizing valve $V_3$, from which the fuel flows through the fuel pipe 59, the fuel passage 60 and the fuel outlet 40*a*, 40*b*, 40*c* or 40*d* to the nozzle N through which the fuel is injected into a branched intake tube (not shown) of the engine 1.

Meanwhile the fuel under pressure also flows into the second inlet 39 from the fuel supply source, and flows further through the fuel passage 58 into the center chamber 51. The fuel flows from the center chamber 51 through the orifice 57 and the fuel passages 56 into the four lower chambers 50. From the lower chamber 50 the fuel returns through the control port 61, the fuel passage 62, the fuel return port 38 and the pressure regulator 37 to the fuel tank 30 (See FIG. 2).

The pressure of the fuel which has flown into the lower chamber 50 is maintained substantially at a predetermined magnitude by the pressure regulators 32 and 37 and is further finely controlled by the fine pressure control device 66. Since the pressure in the lower chamber 50 is constant as described above, the fuel flowing into the upper chamber 49 causes the second metallic diaphragm 45 to deflect downward until the pressure equilibrium is established between the upper and lower chambers 49 and 50. As a result, the degree of opening of the orifice defined by the fuel pipe 59 and the second metallic diaphragm 45 is finally dependent upon the pressure in the lower chamber 50. Since the upper chamber 49 is communicated with the lower chamber 48, the pressure in the latter is equal to the pressure in the former and hence to the pressure in the lower chamber 50. The upper chambers 47 are communicated with the common fuel inlet 36 through the fuel passages 52 so that these chambers 47 have the same pressure and consequently the metallic diaphragm 44 is caused to deflect by the same degree in these chambers 47. As a result, the variable orifices each defined by the fixed orifice 53 and the valve seat 54 have the same degree of opening so that the pressure differences across these variable orifices are also same. As a consequence the quantity or flow rate of the fuel passing through the fixed orifice 53 is same so that the same quantity of fuel may be charged to the respective cylinders.

However, due to the production variety; that is, the variation in machining accuracy, the above described uniform fuel distribution cannot be attained in practice. To solve this problem the pressure in the lower chamber 48 is adjusted in a manner to be described in detail below. That is, as described above the pressure in the lower chamber 48 is equal to the pressure in the lower chamber 50. Therefore, when the degree of opening of the control port 61 to the fuel passage 62 is adjusted by the fine pressure adjusting device 66 by displacing the adjusting rod 63, the pressure in the lower chamber 50 and hence the pressure in the lower chamber 48 may be individually controlled. As a consequence, the differential pressure across each orifice 53 can be maintained same and uniform so that the fuel may be uniformly distributed. The spring 64 in the fine pressure adjusting device 66 serves to hold the adjusting rod 63 at an adjusted position, and the O-ring 65 prevents the leakage of fuel to the exterior.

Thus the fuel which has been metered proportionally to the quantity of intake air by the fuel metering device 16 may be uniformly distributed by the distributor 35 so that the fuel may be charged into the respective cylinders in a quantity optimumly proportional to the quantity of intake air.

So far the present invention has been described in conjunction with the four-cylinder engine, but it will be understood that the distributor 35 may be suitably modified depending upon the number of cylinders. Instead of metering the fuel in response to the quantity of intake air sensed by the sensing valve 6, the fuel may be metered by sensing the negative intake air pressure, rotational speed or any other suitable factors representative of the operating conditions of the engine.

In summary, the present invention provides only one fuel metering orifice for controlling the quantity of fuel in response to the quantity of intake air so that the fuel metering device may be much simplified in construction and fabrication as compared with the prior art fuel control systems wherein the fuel metering devices are provided for respective cylinders. In addition, the fuel may be metered and distributed with a higher degree of accuracy depending upon the quantity of intake air. Furthermore, there is a further advantage in that the distributor may be fabricated at less cost by the conventional manufacturing processes.

What is claimed is:

1. In a fuel control system for an internal combustion engine of the type wherein the quantity of fuel to be supplied to respective fuel injection nozzles is controlled by a fuel metering device having a single fuel metering orifice whose degree of opening is variable in response to the quantity of intake air and a differential pressure regulating valve for maintaining the differential pressure of fuel across said fuel metering orifice at a predetermined mangitude, said system further comprising a distributor comprising:

(a) a plurality of distribution valves equal in number to the number of cylinders of the engine, each distribution valve comprising:
  two chambers partitioned by a diaphragm, an orifice formed through said diaphragm for hydraulically communicating said two chambers, said orifice having a predetermined area of opening, and
  a valve seat positioned in opposed relation with said orifice;

(b) a plurality of fuel passages each hydraulically communicating one of said two chambers of each distribution valve and said fuel metering device for supplying the fuel from the latter to the said one chamber, (c) a plurality of pressure equalizing valves equal in number to the number of cylinders of the engine, each pressure equalizing valve being communicated with the other chamber of each distribution valve for maintaining the pressure of fuel in said other chamber at a predetermined magnitude, each pressure equalizing valve comprising:
  a first chamber in communication with said other chamber of each distribution valve,
  a second chamber partitioned from said first chamber by a diaphragm, the pressure in said second chamber being maintained at a predetermined magnitude, and
  fine pressure adjusting means for finely adjusting the pressure of fuel in said second chamber, (d) a plurality of fuel passages each hydraulically communicating each pressure equalizing valve and each fuel injection nozzle, whereby the fuel metered by said fuel metering device may be uniformly distributed among the cylinders of the engine.

2. A fuel control system for a spark-ignition internal combustion engine having an intake tube and a plurality of cylinders comprising:

(a) a throttle valve which is disposed within the intake tube of said spark ignition internal combustion engine and is suitably controlled by a driver;

(b) an air flow measuring member disposed within the intake tube upstream of said throttle valve for swinging movement in response to the quantity of intake air flowing through said intake tube;

(c) a pressure responsive actuator operatively coupled to said air flow measuring member for maintaining the differential pressure across it at a predetermined magnitude;

(d) a fuel supply source for supplying the fuel under a predetermined pressure;

(e) fuel metering means operatively coupled to said air flow measuring member and hydraulically communicated with said fuel supply source for metering the fuel to be distributed to all cylinders of the engine in response to the quantity of intake air, said fuel metering means having a fuel metering shaft for unitary rotation with said air flow measuring member, a bearing member for rotatably receiving said fuel metering shaft, said fuel metering shaft and said bearing member defining a fuel metering orifice, and a differential pressure regulating valve hydraulically communicated with said fuel metering orifice for maintaining the differential pressure of fuel across said fuel metering orifice at a predetermined magnitude; and (f) a distributor for uniformly distributing among the cylinders of the engine the fuel from said fuel metering means, said distributor comprising:

(i) first, second and third housing sections, (ii) a first diaphragm interposed between said first and second housing sections and a second diaphragm interposed between said second and third housing sections, (iii) a plurality of distribution valves equal in number to the number of cylinders of the engine, each distribution valve having first and second chambers defined within said first and second housing sections, respectively, and partitioned by said first diaphragms and communicated with each other through a fixed orifice formed through said first diaphragm, and a valve seat disposed in said first chamber in opposed relation with said fixed orifice, (iv) a plurality of fuel passages formed in said first housing section each for supplying the fuel from said fuel metering means to said first chamber of each distribution valve, (v) a plurality of pressure equalizing valves equal in number to the number of cylinders of the engine, each pressure equalizing valve comprising: first and second chambers defined within said second and third housing sections, respectively, and partitioned by said second diaphragm, and a fuel pipe extending into said first chamber with its free end in opposed relation with said second diaphragm and hydraulically communicated with each fuel injection nozzle, (vi) a plurality of fuel passages each hydraulically communicating said second chamber of each distribution valve and said first chamber of said pressure equalizing valve, (vii) a plurality of fuel passages each hydraulically communicating said fuel supply source and said second chamber of each pressure equalizing valve, and (viii) a plurality of fine pressure adjusting means each finely adjusting the pressure of fuel in the second chamber of said each pressure equalizing valve.

3. A fuel control system for an internal combustion engine comprising:

intake-air detecting means for detecting an amount of intake-air sucked into an internal combustion engine;

fuel metering means, operatively connected with said intake-air detecting means, for metering fuel to be supplied to said engine in such a manner that the amount of the fuel is proportional to that of the intake-air; and fuel distributing means for distributing the fuel to respective fuel injection nozzles in such a manner that the amount of fuel distributed to each nozzle is equal to the amount supplied to each other nozzle, wherein said distributing means comprises:

a plurality of distribution valves equal in number to the number of cylinders of said engine, each having first and second chambers partitioned by a diaphragm, said first chamber being communicated with said fuel metering means, and means for allowing the fuel introduced into said first chamber to flow to said second chamber;

a plurality of pressure equalizing valves equal in number to the number of cylinders of said engine, each having third and fourth chambers partitioned by another diaphragm, said third chamber being in fluid communication with said second chamber, a source of pressure in said fourth chamber for applying a constant pressure to said other diaphragm towards said third chamber, and means for controlling the pressure in said third chamber at a constant value in accordance with said constant pressure, whereby the amount of fuel flowing to said second chamber of one of said distribution valves become equal to that of fuel flowing to said second chamber of the other distribution valves;

a plurality of fuel passages each hydraulically intercommunicating respective third chambers with the respective fuel injection nozzles through said pressure controlling means, and pressure adjusting means for adjusting the value of said constant pressure in said fourth chamber of each said pressure equalizing valve.

* * * * *